US008497059B2

(12) United States Patent
Oshiba et al.

(10) Patent No.: US 8,497,059 B2
(45) Date of Patent: Jul. 30, 2013

(54) PRODUCING METHOD OF TONER FOR DEVELOPING STATIC IMAGE

(75) Inventors: Tomomi Oshiba, Hachioji (JP); Mikihiko Sukeno, Hino (JP); Hajime Tadokoro, Yokohama (JP); Ken Ohmura, Hachioji (JP); Tatsuya Nagase, Tachikawa (JP); Kenji Hayashi, Hachioji (JP); Saburou Hiraoka, Kodaira (JP); Tomoko Mine, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 88 days.

(21) Appl. No.: 13/228,030

(22) Filed: Sep. 8, 2011

(65) Prior Publication Data

US 2012/0064454 A1 Mar. 15, 2012

(30) Foreign Application Priority Data

Sep. 15, 2010 (JP) ..... 2010-206398

(51) Int. Cl.
*G03G 9/087* (2006.01)

(52) U.S. Cl.
USPC ..... 430/137.17; 430/109.4; 430/137.16

(58) Field of Classification Search
USPC ..... 430/109.4, 137.17, 137.16
See application file for complete search history.

(56) References Cited

U.S. PATENT DOCUMENTS

| | | | | |
|---|---|---|---|---|
| 2005/0042534 | A1 | 2/2005 | Tanaka | |
| 2008/0166647 | A1 | 7/2008 | Mang | |
| 2008/0182193 | A1* | 7/2008 | Agur et al. | 430/109.4 |
| 2009/0286176 | A1* | 11/2009 | Ohmura et al. | 430/107.1 |
| 2011/0091806 | A1* | 4/2011 | Hayashi et al. | 430/137.15 |

FOREIGN PATENT DOCUMENTS

| | | | |
|---|---|---|---|
| EP | 2 172 812 | | 4/2010 |
| JP | 2008-262166 | A | 10/2008 |
| JP | 2009-223281 | A | 10/2009 |

OTHER PUBLICATIONS

European Search Report EP 11 18 0908 (5 pages).

* cited by examiner

*Primary Examiner* — Janis L Dote
(74) *Attorney, Agent, or Firm* — Lucas & Mercanti, LLP

(57) ABSTRACT

A method of producing a toner comprising toner particles containing a binder resin composed of a non-crystalline polyester resin having a crosslinked structure and a crystalline polyester resin is disclosed, the method comparing steps of;

a process to form an oil phase liquid by dissolving or dispersing a non-crystalline polyester resin having a polymerizable unsaturated double bond and a crystalline polyester resin in an organic solvent, a process to form an aqueous dispersion liquid of oil droplets of the oil phase liquid by dispersing the oil phase liquid in an aqueous medium, a process to form oil droplets containing the non-crystalline polyester resin having a crosslinked structure by adding a radical polymerization initiator to the aqueous dispersion liquid of oil droplets, and an organic solvent removing process to form toner particles by removing organic solvent.

14 Claims, No Drawings

PRODUCING METHOD OF TONER FOR DEVELOPING STATIC IMAGE

This application is based on Japanese Patent Application No. 2010-206398 filed on Sep. 15, 2010 in Japanese Patent Office, the entire content of which is hereby incorporated by reference.

TECHNICAL FIELD

This invention relates to a producing method of a toner for developing a static image used for an electrophotographic image forming.

BACKGROUND

Recently, energy saved electrophotographic image forming apparatus is required to in view of countermeasure of global environment contamination, in particular, image forming apparatus energy saving of fixing system, which consumes a plenty amount of energy among the electrophotographic image forming apparatus, is required.

Hitherto, a resin having sharp melt property, specifically crystalline polyester resin, is known to use in a toner as a binder resin for one of an effective method for low temperature fixing. Further, a method using a polyester resin having a crosslinked structure having excellent high temperature elasticity is known to solve problems such as anti-high temperature offset property or anti-heat durable property caused by crystalline polyester resin (see, for example, patent document 1).

However, it is difficult to produce a toner having a small particle diameter containing a polyester resin having a crosslinked structure by above described toner producing method, and therefore, an image having high quality is difficult to form.

On the other side, it is known that a toner having a small particle diameter can be produced by employing polymerization method.

However, it, is difficult to produce a toner containing a polyester resin having a crosslinked structure.

The polyester resin is formed by a dehydration condensation reaction, and it is difficult to progress in water. For the countermeasure, it is proposed a method wherein the polyester resin formed by dehydration condensation reaction is dissolved in organic solvent preliminary, it is dispersed in an aqueous medium to obtain emulsification liquid via phase reversal of emulsion emulsification method or the like, and toner particles are formed using this. However there is a problem in this method because the polyester resin having a crosslinked structure is difficult to be dissolved or dispersed. In organic solvent and needs plenty of energy to dissolve or disperse.

For solving the problem, a method is provided that crosslinked structure is formed when particles are formed employing a polyester resin to which isocyanate group is introduced, (see, for example, patent document 1).

However, there is a problem that it is difficult to control reaction and impossible to produce stably by the toner producing method because of using isocyanate group having extremely high reactivity.

PATENT DOCUMENTS

Patent Document 1: JP-A 2009-223281
Patent Document 2: JP-A 2008-262166

SUMMARY OF THE INVENTION

An object of this invention is to provide a producing method of a toner for developing a static image, by which a toner forming fundamentally a high quality image and having an excellent anti-high temperature offset property in addition to an excellent low temperature fixing property is stably produced.

The producing method of a toner for developing a static image of this invention is described. The method produces a toner for developing a static image comprising toner particles containing a binder resin composed of at least a non-crystalline polyester resin having a crosslinked structure and a crystalline polyester resin, and the method comprises steps of;

(a) an oil phase liquid preparation process to dissolve or disperse a non-crystalline polyester resin having a polymerizable unsaturated double bond and a crystalline polyester resin in an organic solvent, (b) an aqueous dispersion liquid of oil droplets preparation process to form oil droplets of the of phase liquid in an aqueous medium, (c) crosslinked structure forming process to form oil droplets containing the non-crystalline polyester resin having a crosslinked structure by adding a radical polymerization initiator to the aqueous dispersion liquid of oil droplets, and (d) organic solvent removing process to form toner particles by removing organic solvent.

It is preferable that dispersion particle diameter of oil droplets in aqueous dispersion liquid prepared in the aqueous dispersion liquid of oil droplets preparation process is 60 to 1,000 nm in the producing method of this invention.

The toner for developing a static image of this invention is produced by the above described producing method of a toner for developing a static image.

Advantage of the Invention

A toner which forms a high quality image and has an excellent low temperature fixing property as well as an excellent anti-high temperature offset property can be produced with low cost since crosslinked structure is formed in a state in which a polyester resin is fundamentally dispersed into microparticles in an aqueous medium according to the producing method of this invention.

Further it is easy to control reaction and production is stable since crosslinked structure is formed by a radical polymerization reaction using a polymerizable unsaturated double bond without introducing isocyanate group which has extremely high reactivity, according to the producing method of this invention.

EMBODIMENTS PRACTICING THE INVENTION

The invention is described practically.

Toner Producing Method

The producing method of toner according to this invention is a method producing a toner for developing a static image comprising toner particles containing a binder resin composed of at least a non-crystalline polyester resin having a crosslinked structure and a crystalline polyester resin (hereafter, referred also to "a non-crystalline polyester resin having a crosslinked structure"), which comprises steps of;

an oil phase liquid preparation process to dissolve or disperse a non-crystalline polyester resin having a polymerizable unsaturated double bond (hereafter, referred also to "an unsaturated non-crystalline polyester resin") and a crystalline polyester resin in an organic solvent, an aqueous dispersion liquid of oil droplets preparation process to form oil droplets of the oil phase liquid in an aqueous medium, crosslinked structure forming process to form oil droplets containing the non-crystalline polyester resin having a crosslinked structure by adding a radical polymerization initiator to the aqueous dispersion liquid of oil droplets, and organic solvent removing process to form toner particles by removing organic solvent.

Specific example of the toner producing method comprises steps of, (1-A) synthesize process of a crystalline polyester resin to synthesize a crystalline polyester resin, (1B) synthesize process of an unsaturated non-crystalline polyester resin to synthesize an unsaturated non-crystalline polyester resin, (2) oil phase liquid preparation process to prepare oil phase liquid in which a mixture of toner forming components containing a crystalline polyester resin, an unsaturated non-crystalline polyester resin, and, according to necessity, a colorant, a releasing agent, a charge controlling agent and the like in organic solvent, are dissolved or dispersed, (3) preparation process of aqueous dispersion liquid of oil droplet to form oil droplets of the oil phase liquid in an aqueous medium, (4) crosslinked structure formic process to form oil droplets containing the non crystalline polyester resin having a crosslinked structure by adding a radical polymerization initiator to the aqueous dispersion liquid of oil droplets, (5) organic solvent removing process to form toner particles by removing organic solvent, (6) filtration/washing process separating toner particles from an aqueous medium, and washing and removing a surfactant from toner particles, (7) drying process of washed toner particles, and further, according to necessity, (8) external additive addition process to add an external additive to the dried toner particles.

(1-A) Synthesize Process of Crystalline Polyester Resin

This is a process to synthesize crystalline polyester resin which is a raw material for a binder resin to compose toner particles.

In the crystalline polyester resin is a polyester resin having definite endothermic peak but not stepwise endothermic change in differential scanning calorimetry (DSC). The crystalline polyester resin is not restricted as far as it has such characteristics described above, and includes, for example, a resin in which other component is copolymerized to a backbone of the crystalline polyester resin having definite endothermic peak as described above.

The melting point of the crystalline polyester resin indicates the temperature of the peak top at the crystalline polyester resin endothermic peak and can be measured, for example, by using "DSC-7 Differential Scanning calorimeter" (manufactured by PerkinElmer Inc.) or "TAC7/DX Thermal Analyzer Controller" (manufactured by PerkinElmer Inc.).

Specifically, 0.5 mg of a crystalline polyester resin is weighed accurately down to the second decimal place, is charged into an aluminum pan (KITNO. 0219-0041), is set in a DSC-7 sample holder, is subject to the temperature control of Heat-Cool-Heat under the condition of a measuring temperature of 0° C. to 200° C., a temperature rising speed of 10° C./minute, and a temperature falling speed of 10° C./minute, and is analyzed on the basis of the data at the second Heat. For reference measurement, an empty aluminum pan is used.

The crystalline polyester resin has preferably a number average molecular weight (Mn) of 100 to 10,000, more preferably 800 to 5,000, and a weight average molecular weight (Mw) of preferably 1,000 to 50,000, and more preferably 2,000 to 30,000, via a THF soluble part gel permeation chromatography.

Molecular determination via GPC is carried out as follows: namely, using apparatus "HLC-8220" (produced by Tosoh Corp.) and column "TSK guard column+TSK GEL SUPER HZM-M (three in series)" (produced by Tosoh Corp.), as a carrier solvent is passed at a flow rate of 0.2 ml/min, and a measurement sample is dissolved in tetrahydrofuran so as for the concentration thereof to be 1 mg/ml under a condition in that dissolution is carried out using an ultrasonic dispersing device at room temperature for 5 minutes. Then a sample solution is obtained via treatment of a membrane filter of a 0.2 μm pore size, and 10 μl thereof is injected into the above apparatus along with the carrier solvent for detection using a refractive index detector (RI detector). Subsequently, the molecular weight of the measurement sample is calculated using a calibration curve wherein the molecular weight distribution of the sample is determined employing a monodispersed polystyrene standard particle. As the standard polystyrene sample used to obtain the calibration curve, there are employed any of those featuring a molecular weight of $6\times10^2$, $2.1\times10^3$, $4.6\times10^3$, $1.75\times10^4$, $5.1\times10^4$, $1.1\times10^5$, $3.9\times10^5$, $8.6\times10^5$, $2\times10^6$ and $4.48\times10^6$. The calibration curve is drawn by connecting at least 10 points obtained via measurement using the standard polystyrene sample. Further, as a detector, the reflective index detector is utilized.

The crystalline polyester resin can be formed of dicarboxylic acid component and diol component.

Aliphatic dicarboxylic acid is preferably usable as the dicarboxylic acid component, and aromatic dicarboxylic acid may be used in combination. As the aliphatic dicarboxylic acid straight chain type is preferably used. The dicarboxylic acid component is not limited to one species but two or more species may be used in mixture.

Examples of aliphatic dicarboxylic acid include oxalic acid, malonic acid, succinic acid, glutaric acid, adipic acid, pimelic acid, suberic acid, azelaic acid, sebacic acid, 1,9-nonan dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid and 1,18-octadecane dicarboxylic acid. Lower alkyl esters or anhydride acids of these dicarboxylic acids may be employed. Adipic acid, sebacic acid and 1,10-decane dicarboxylic acid are preferably used among above described aliphatic dicarboxylic acids in view of easy availability.

Examples of aromatic dicarboxylic acid used with the aliphatic dicarboxylic acid include terephthalic acid, isophthalic acid, orthophthalic acid, t-butyl isophthalic acid, 2,6-naphthalene dicarboxylic acid and 4,4'-biphenyl dicarboxylic acid. Terephthalic acid, isophthalic acid and t-butyl isophthalic acid is preferably used among these in view of easy availability and easy emulsification property.

Amount of aromatic dicarboxylic acid to be used is preferably 20 component mol % or less when the total amount of dicarboxylic acid component to form the crystalline polyester resin being 100 component mol %, more preferably 10 component mol % or less and preferably 5 component mol % or less particularly.

In case that the amount of the aromatic dicarboxylic acid is 20 component mol % or less, crystallinity of the crystalline polyester resin is maintained, excellent low temperature fixing property is obtained in the toner to be manufactured, and glossiness is obtained in the finally formed image, deterioration of image storage ability is inhibited due to lowering of melting point. And further, emulsion state is certainly obtained when oil droplets are fanned by employing oil phase liquid containing the crystalline polyester resin.

It is preferable to used aliphatic diol as the dial component, and, according to necessity, diols other than aliphatic diol may be incorporated.

It is preferable to use straight-chain aliphatic dial having 2 to 22 carbon atoms for composing main chain among the aliphatic dials as a diol component, and in particular preferably straight-chain aliphatic diol having carbon 2 to 14 atoms for composing main chain in view of easy availability, exhibiting certain low temperature fixing property and obtaining high glossiness image.

When the straight-chain aliphatic diol having 2 to 22 carbon atoms for composing main chain is used, a polyester resin having a melting point at such a level as inhibiting low temperature fixing property is not formed, sufficient low temperature fixing property is obtained in toner to be manufactured, and glossiness is obtained in the finally formed image when aromatic dicarboxylic acid is used as the dicarboxylic acid component in combination.

Branched type of aliphatic diol may be used for diol component, and in this instance, it is preferable to use straight-chain aliphatic diol in combination and content ratio of the straight-chain aliphatic diol is made higher in view of obtaining certain crystallinity. When the content ratio of used straight-chain aliphatic diol is higher, crystallinity is obtained certainly and excellent low temperature fixing property is obtained in toner to be manufactured, a deterioration of image storage ability due to lowering melting point is inhibited, and further anti-blocking property can be obtained certainly in the image finally formed.

The diol component is not limited to one species but two or more species nay used in mixture.

It is preferable to use content of aliphatic diol is set as 80 component mol % or more in the diol component to form the crystalline polyester resin, and more preferably 90 component mol % or more. When the diol component content of aliphatic diol is 80 component mol % or more, crystallinity of the crystalline polyester resin is obtained certainly and excellent low temperature fixing property is obtained in toner to be manufactured and glossiness is obtained in the image finally formed.

Examples of aliphatic diol include ethylene glycol, 1,3-propanediol, 1,4-butanediol, 1,5-pentane glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol, and it is preferable to use ethylene glycol, 1,4-butanediol, 1,6-hexanediol, 1,9-nonanediol and 1,10-decanediol, among them.

Examples of diol other than aliphatic diol include diols having a double bond and diols having a sulfonic acid group, specifically, 2-butene-1,4-diol, 3-hexene-1,6-diol and 4-octene-1,8-diol are listed for the diols having a double bond.

Content ratio of the diols having a double bond in the diol component is preferably 20 component mol % or less and more preferably 2 to 10 component mol %. When the content ratio of the diols having a double bond in the diol component is 20 component mol % or less, melting point of the polyester resin to be obtained is not so much lowered, and therefore, there is small probability to generate filming.

Content ratio of the dicarboxylic acid component to diol component as used is preferably made so that equivalent ratio of hydroxyl group [OH] in diol component to carboxyl group [COOH] in dicarboxylic acid component [OH]/[COOH] is 1.5/1 to 1/1.5, and more preferably 1.2/1 to 1/1.2.

When the content ratio of dicarboxylic acid component to diol component as used is satisfies the range as above described, a crystalline polyester resin having expected molecular weight can be obtained certainly.

(1-B) Synthesis Process of Unsaturated Non-Crystalline Polyester Resin

This is a process to synthesize an unsaturated non-crystalline polyester resin for obtaining a crosslinked non-crystalline polyester resin which is a raw material of a binder resin to compose toner particles.

The non-crystalline polyester resin is polyester other than the crystalline polyester resin, and ordinarily has no melting point and has relatively high glass transition point temperature (Tg) in this invention.

The unsaturated non-crystalline polyester resin can be synthesized by employing polyalcohol and polycarboxylic acid at least one of which has a polymerizable unsaturated double bond in the same synthesis process as above described crystalline polyester resin.

The polyalcohol and polycarboxylic acid at least one of which has a polymerizable unsaturated double bond mean any one of combinations of, (1) polyalcohols all or part of which have a polymerizable unsaturated double bond and polycarboxylic acid having no polymerizable unsaturated double bond, (2) polyalcohols having no polymerizable unsaturated double bond and polycarboxylic acids all or part of which have a polymerizable unsaturated double bond, and (3) polyalcohols all or part of which have a polymerizable unsaturated double bond and polycarboxylic acids all or part of which have a polymerizable unsaturated double bond.

Non crystalline polyester resin can be synthesized by known methods using above described monomer components optionally in combination. Methods such as ester exchange method and direct condensation polymerization method can be used singly or in combination.

Specifically, the synthesis can be conducted at a polymerization temperature of 140 to 270° C., and, according to necessity, reaction is conducted while removing water and alcohol generated during condensation reaction by reducing pressure within the reaction system. In case that the monomers are not dissolve or not miscible at reaction temperature, solvent having high boiling point may be added to dissolve as a dissolving aid. In a condensation polymerization reaction, synthesis is conducted while removing the dissolving aid by distillation. In case of ester exchange reaction, monomers removable by distillation at vacuum such as ethylene glycol, propylene glycol, neopentyl glycol, cyclohexane diol are used in access.

Catalyst usable in the production of polyester resin include alkali metal compound such as sodium and lithium; alkali-earth metal compound such as magnesium and calcium; metal compound such as zinc, manganese, antimony, titanium, tin, zirconium and germanium; phosphorous compound; phosphate compound; and amine compound. Specifically listed are compounds such as sodium acetate, sodium carbonate, sodium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl, octylate germanium oxide, triphenyl phosphite, tris(2,4-di-t-butyl phenyl) phosphite, ethyltriphenyl phosphonium bromide, triethylamine and triphenylamine. A stable titanium compounds such as titanium tetrabutoxide are preferable.

A glass transition point temperature (Tg) of the unsaturated non-crystalline polyester resin is preferably 20 to 90° C., and in particular 35 to 65° C. is more preferable.

The softening point of the unsaturated non-crystalline polyester resin is preferably from 80 to 220° C., more preferably from 80 to 150° C.

Herein, the glass transition temperature (Tg) of the unsaturated non-crystalline polyester resin is determined using differential scanning calorimeter DSC-7 (produced by Perkin Elmer, Inc.) and thermal analyzer controller "TAC7/DX" (produced by Perkin Elmer, Inc.). Specifically, 4.50 mg of the unsaturated non-crystalline polyester resin is sealed in an aluminum pan (Kit No. 0219-0041) and placed in a DSC-7 sample holder. An empty aluminum pan is used as the reference measurement. Subsequently, heating-cooling-heating temperature control is carried out over a measurement temperature range of 0 to 200° C. under measurement conditions of a temperature increasing rate of 10° C./min and a temperature decreasing rate of 10° C./min. Measured data is obtained during the second heating stage, and then a glass transition point (Tg) is obtained as a value which is read at the intersection of the extension of the base line, prior to the initial rise of the first endothermic peak, with the tangent showing the maximum inclination between the initial rise of the first endothermic peak and the peak summit. In this instance, during the first temperature increase, temperature is kept at 200° C. for 5 minutes.

The softening point is determined as follows: at first, 1.1 g of the unsaturated non-crystalline polyester resin is placed in a Petri dish at ambiences of 20° C. and 50% RH, followed by being made even and by being allowed to stand for at least 12 hours, and thereafter a pressed sample of a 1 cm diameter columnar shape is prepared via compression at a compression pressure of 3,820 kg/cm$^2$ for 30 seconds using press instrument SSP-10A (produced by Shimadzu Corp.). Subsequently, using flow tester CFT-500D (produced by Shimadzu Corp.) at ambiences of 24° C. and 50% RH, the pressed sample is extruded through the columnar die orifice (1 mm diameter×1 mm) by use of a 1 cm diameter piston, starting at the time of the termination of preheating, under conditions of a weight of 196 N (20 kgf), an initial temperature of 60° C., preheating duration of 300 seconds, and a temperature increasing rate of 6° C./min. An offset method temperature $T_{offset}$, measured at an offset value of 5 mm via the melt temperature measurement method, being a temperature increasing method, is designated as the softening point.

The unsaturated non-crystalline polyester resin has a number-average molecular weight (Mn) in terms of gel permeation chromatography (GPC) of component soluble in THF of preferably 2,000 to 10,000, and more preferably 2,500 to 8,000. Weight average molecular weight (Mw) is preferable 3,000 to 100,000, and more preferably 4,000 to 70,000.

Measurement of molecular weight by GPC is conducted in a similar way as the measurement of molecular weight of crystalline polyester resin except that an unsaturated non-crystalline polyester resin is used as the sample to be measured.

Polyalcohol used for forming an unsaturated non-crystalline polyester resin includes, in addition to above described aliphatic diols, for example, bisphenols such as bisphenol A and bisphenol F, and alkylene oxide adduct of the bisphenol with ethyleneoxide adduct and propylene oxide adduct. Tri or more valent polyalcohols include glycerin, trimethylolpropane, pentaerythritol and sorbitol. Further, it is preferable to used cyclohexane diol and neopentyl alcohol in view of production cost or influence to environment. These may be uses single or plural in combination.

When unsaturated double bond in the unsaturated non-crystalline polyester resin introduced from polyalcohol, polyalcohol having a polymerizable unsaturated double bond, specifically, alkene diol such as 2-butene-1,4-diol, 3-butene-1,4-diol and 9-octadecene-7,12-diol are used as the polyalcohol to form an unsaturated non-crystalline polyester resin. These may be used single or plural in combination.

Polycarboxylic acid to form the unsaturated non-crystalline polyester resin includes, in addition to the above described aliphatic dicarboxylic acid, aromatic dicarboxylic acid such as phthalic acid, isophthalic acid, terephthalic acid and naphthalene dicarboxylic acid. Further, three or more valent polycarboxylic acid such as trimellitic acid and pyromellitic acid may be used for the purpose of adjusting melt viscosity of the obtained an unsaturated non-crystalline polyester resin. These may be used singly or plural in combination.

When unsaturated double bond in the unsaturated non-crystalline polyester resin is introduced from polycarboxylic acid, polycarboxylic acid having a polymerizable unsaturated double bond, specifically, unsaturated aliphatic dicarboxylic acid such as maleic acid, fumaric acid, itaconic acid, citraconic acid, glutaconic acid, isododecylsuccinic acid, n-dodecenyl succinic acid and n-octenyl succinic acid; as well as acid anhydride or acid chloride thereof; unsaturated aromatic carboxylic acid such as coffee acid; are used for polycarboxylic acid to form the unsaturated non-crystalline polyester resin. In particular, it is preferable to use maleic acid, fumaric acid and itaconic acid in view of exhibiting excellent radical polymerization property. These may be used single or plural in combination.

(2) Oil Phase Liquid Preparation Process

This a process to prepare oil phase liquid in which a mixture of toner forming components containing a crystalline polyester resin, an unsaturated non-crystalline polyester resin, and, according to necessity, a colorant, a releasing agent, a charge controlling agent and the like in organic solvent are dissolved or dispersed.

The oil phase liquid is allowed to contain at least a crystalline polyester resin and an unsaturated non-crystalline polyester resin as a component for forming a binder resin, and may further contain a non-crystalline polyester resin having no polymerizable unsaturated double bond or other resins in this invention.

This means that the binder resin in the obtained toner contains at least a crystalline polyester resin and a crosslinked non-crystalline polyester resin, and, according to necessity, a non-crystalline polyester resin having no polymerizable unsaturated double bond or other resins may be incorporated.

At least an unsaturated non crystalline polyester resin is dissolved in organic solvent in the oil phase liquid preparation process. The crystalline polyester may be in a state of dissolved or dispersed in organic solvent.

The other additives may be in a state of dissolved or dispersed.

It is allowed that preliminarily kneaded material of a non crystalline polyester resin, a crystalline polyester resin, and other additives according to necessity is subjected to dissolving or dispersing in organic solvent. It is also allowed that non crystalline polyester resin is dissolved in organic solvent, and then crystalline polyester resin and other additives according to necessity, are added, and they are dispersed via a dispersion apparatus having medium such as ball mill, sand mill, or high pressure dispersion apparatus.

When the kneading method is used, kneading temperature (resin temperature) is preferably from 20° C. lower to 50° C. higher than the softening point of the non crystalline polyester resin.

The method to dissolve the non crystalline polyester resin in organic solvent is not particularly limited. They are put into a flask equipped with a condenser, stirring device and a thermometer, and are stirred until the non crystalline polyester is dissolved. Stirring temperature is preferably set in a range from normal temperature to temperature not exceeding boiling point of the solvent.

Organic solvent used in the preparation of the oil phase liquid is preferably those having low boiling point and low solubility in water in view of easy removing in the organic solvent removing process. Specifically, for example, methyl acetate, ethyl acetate, methyl ethyl ketone, methylisobutyl ketone, toluene and xylene are listed. These may be used singly or plural in combination.

Usable amount of the organic solvent is usually 1 to 300 parts by mass based on 100 parts by mass of a component for forming the binder resin, preferable 1 to 100 parts by mass, and more preferably 25 to 70 parts by mass.

It is preferable that a relative content ratio of the crystalline polyester resin to the unsaturated non-crystalline polyester resin in the oil phase liquid is 1:99 to 40:60 by mass, and more preferably) 10:90 to 40:60. Satisfying the ratio of the crystalline polyester resin to an unsaturated non-crystalline polyester resin in the oil phase liquid within the above described range, low temperature fixing property and mechanical strength are obtained compatibility.

Colorant

The toner of this invention may contain a colorant when it is used as a color toner. Generally known dyes and pigments may be used as the colorant.

Various known materials may be used optionally for the colorant for black toner, for example, carbon black such as furnace black and channel black, magnetic material such as magnetite and ferrite, a dye, an inorganic pigment containing non-magnetic iron oxide.

Various known materials may be used for the colorant for color toners, including a dye and an organic pigment optionally. Specifically include organic pigments such as C.I. Pigment Red 5, Pigment Red 48:1, Pigment Red 53:1, Pigment Red 57:1, Pigment Red 81:4, Pigment Red 122, Pigment Red 139, Pigment Red 144, Pigment Red 149, Pigment Red 166, Pigment Red 177, Pigment Red 178, Pigment Red 222, Pigment Red 238, Pigment Red 269; C.I. Pigment Yellow 14, Pigment Yellow 17, Pigment Yellow 74, Pigment Yellow 93, Pigment Yellow 94, Pigment Yellow 138, Pigment Yellow 155, Pigment Yellow 180, Pigment Yellow 185; C.I. Pigment Orange 31, Pigment Orange 43; C.I. Pigment Blue 15:3, Pigment Blue 60, Pigment Blue 76, and dyes such as C.I Solvent Red 1, Solvent Red 49, Solvent Red 52, Solvent Red 58, Solvent Red 68, Solvent Red 11, Solvent Red 122; C.I. Solvent Yellow 19, Solvent Yellow 44, Solvent Yellow 77, Solvent Yellow 79, Solvent Yellow 81, Solvent Yellow 82, Solvent Yellow 93, Solvent Yellow 98, Solvent Yellow 103, Solvent Yellow 104, Solvent Yellow 112, Solvent Yellow 162, C.I. Solvent Blue 25, Solvent Blue 36, Solvent Blue 69, Solvent Blue 70, Solvent Blue 93 and Solvent Blue 95.

Colorants may be used one or two or more species in combination for obtaining respective color.

Content amount of colorant in the oil phase liquid is 1 to 15% by mass based on the whole solid substance in the oil phase liquid, and preferably 4 to 10% by mass. When an amount of the colorant is insufficient, desired coloring may not be obtained, and when it is in excess, isolation and adhesion to carrier may be generate to influence chargeability.

Releasing Agent

Listed as specific examples of release agents used herein may be low molecular weight polyolefins such as polyethylene, polypropylene or polybutene; synthesis ester wax, plant based wax such as carnauba wax, rice wax, candelilla wax, japan tallow and jojoba oil; mineral petroleum based wax such as montan wax, paraffin wax, microcrystalline wax and Fischer-Tropsch wax; and denatured material of these.

A content amount of the charge controlling agent in the oil phase liquid is usually 0.1 to 10 parts by mass based on 100 parts by mass of the binder resin of finally obtained toner particles and preferably 0.5 to 5 parts by mass.

Charge Controlling Agent

Various known compounds may be used as a charge controlling agent.

A content amount of the charge controlling agent in the oil phase liquid is usually 0.1 to 10 parts by mass based on 100 parts by mass of the binder resin of finally obtained toner particles and preferably 0.5 to 5 parts by mass.

(3) Aqueous Dispersion Liquid of Oil Droplets Preparation Process

This is a process to disperse oil phase liquid prepared as described above in an aqueous medium via a phase reversal of emulsion method.

The aqueous medium refers to a medium containing water in an amount of at least 50% by mass. As components other than water are cited water-soluble organic solvents and examples thereof include methanol, ethanol, isopropanol, butanol, acetone, methyl ethyl ketone and tetrahydrofuran. Of these solvents, it is preferred to use organic solvents which do not dissolve a resin, for example, alcoholic solvents such as methanol, ethanol, isopropanol and butanol.

Aqueous dispersion liquid preparation process is conducted preferably at a temperature lower than that of organic solvent.

The amount of the aqueous medium is preferably from 50 to 2,000 parts by weight and more preferably from 100 to 1,000 parts by mass, based on 100 parts by mass of a toner forming material solution.

An amount of the aqueous medium, falling within the foregoing range can achieve the desired particle size of emulsifying dispersion in the aqueous medium.

Aqueous medium is added to oil phase, and mechanical energy is applied in the emulsification dispersion of oil phase liquid. The oil droplets are took time by time to observe particle diameter, and aqueous dispersion liquid of the oil droplets preparation process is terminated at a time when oil droplets have desired particle diameter of dispersion.

The emulsification dispersion of the oil phase liquid can be conducted by using mechanical energy. A dispersion device used for emulsification dispersion is not particularly limited and includes a low speed shearing type dispersion device, a high speed shearing type dispersion device, a frictional dispersion device, a high pressure jet type dispersion device and an ultrasonic dispersion device, specifically a TY-type homomixer (produced by Tokushukika Kogyo Co. Ltd.) is listed.

Dispersion particle diameter of oil droplets is preferably 60 to 1000 nm, and more preferably 80 to 500 nm.

Dispersion particle diameter of oil droplets is a volume based median diameter measured by employing a laser diffraction/scattering type particle size distribution measuring apparatus LA-750 (HORIBA, Ltd.). The dispersion particle diameter of oil droplets can be controlled by adjusting mechanical energy during emulsification dispersion.

When the dispersion particle diameter of oil droplets satisfies in a range of 60 to 1,000 nm, the oil droplets has preferable surface area on which crosslinked reaction occurs, and low temperature fixing property and anti-high temperature offset property can be compatibly satisfied with high level.

A dispersion stabilizer is dissolved in the aqueous medium. Further, surfactants are also added to the aqueous medium to achieve enhanced dispersion stability of oil-droplets.

Examples of a dispersion stabilizer include inorganic compounds such as tricalcium phosphate, calcium carbonate, titanium oxide, colloidal silica and hydroxy-apatite. Of these, an acid- or alkali-soluble dispersion stabilizer such as tricalcium phosphate is preferred in terms of necessity of removing the dispersion stabilized from the obtained colored particles and the use of an enzyme-degradable one is preferred in terms of environment concern.

Exemplary surfactants include anionic surfactants such as alkylbenzenesulfonate, α-olefin sulfonate, and phosphoric acid ester; cationic surfactants including an amine salt type such as an alkylamine salt, an aminoalcohol fatty acid derivative, and a quaternary ammonium alt type such as alkyltrimethylammonium, a dialkyldimethylammonium salt, an alkyldimethylbenzyl ammonium salt, a pyridinium salt, an alkylisoquinolinium and benzethonium chloride; nonionic surfactants such as fatty acid amide derivatives, polyol derivatives; amphoteric surfactants such as alanine, dodecyl-di-(aminoethyl)glycine, di(octylaminoethyl)glycine and N-alkyl-N,N-dimethylammonium betaine. Anionic or cationic, fluoroalkyl-containing surfactants are also usable.

It is preferable that particle diameter of the resin microparticles is 0.5 to 3 μm for improving dispersion stability, and specifically, methyl polymethacrylate resin microparticles having particle diameter of 1 μm and 3 μm, polystyrene resin microparticles having particle diameter of 0.5 μm and 2 μm, and polystyrene acrylonitrile resin microparticles having particle diameter of 1 μm are listed.

(4) Crosslinked Structure Forming Process

This is a process to generate a crosslinked non-crystalline polyester resin which is a component having high elasticity by adding a radical polymerization initiator to aqueous dispersion liquid of oil droplets, whereby a polymerizable unsaturated double bond of the unsaturated non-crystalline polyester resin is subjected to radical polymerization reaction to form a crosslinked structure.

Radical polymerization initiators include azo type or diazo type polymerization initiators such as 2,2'-azobis-(2,4-di-methylvaleronitrile), 2,2'-azobisisobutylnitrile, 1,1'-azobis (cyclohexane-1-carbonitrile), 2,2'-azobis-4-methoxy-2,4-dimethylvaleronitrile, azobisisobutylnitrile; peroxide type polymerization initiators and oil soluble polymerization initiators having peroxide in a side chain such as benzoylperoxide, methyl ethyl ketone peroxide, diisopropyl peroxycarbonate, cumene hydroperoxide, t-butyl hydroperoxide, di-t-butyl peroxide, di-cumyl peroxide, 2,4-di-chloro benzoylperoxide, lauroyl peroxide, 2,2-bis-(4,4-t-butyl peroxy cyclohexyl) propane, tris(t-butyl peroxy) triazine; water soluble initiators such as 2,2'-azobis[2-(2-imidazoline-2-yl)propane]di-hydrochloric acid salt, 2,2'-azobis[2-(2-imidazoline-2-yl)propane] di-sulfuric acid salt anhydride, 2,2'-azobis(2-methylpropione amidine)di-hydrochloric acid salt, 2,2'-azobis[N-(2-carboxyethyl)-2-methylpropione amidine]hydrate, 2,2'-azobis{2-[1-(2-hydroxyethyl)-2-imidazoline-2-yl]propane}di-hydrochloric acid salt, 2,2'-azobis[2-(2-imidazoline-2-yl)propane], 2,2'-azobis(1-imino-1-pyrrolidino-2-ethylpropane) di-hydrochloric acid salt, 2,2'-azobis{2-methyl-N-[1,1-bis(hydroxy methyl)-2-hydroxyethyl]propionamide} and 2,2'-azobis[2-methyl-N-(2-hydroxyethyl)propionamide]; water soluble polymerization initiators such as persulfates such as potassium persulfate and ammonium persulfate, azobis amino dipropane acetic acid salt, azobis cyano valerianic acid and their salts and hydrogen peroxide. These may be used singly or two or more in combination.

Usable amount of the radical polymerization initiator is determined according to species of unsaturated non crystalline polyester, number of unsaturated bonds and number of cross links to form.

Reaction temperature is determined by using 10 hour half-value temperature of radical polymerization initiator as a measure, for example, it is conducted in a range of 10 hour half-value temperature minus 10° C. to 10 hour half-value temperature plus 30° C.

Reaction time is determined by using polymerization temperature and half-life time of the initiator at the temperature as a measure, for example, 0.5 to 2 times of half-life time of the initiator.

(5) Organic Solvent Removing Process

This is a process to remove organic solvent from oil droplets, after aqueous dispersion liquid of oil droplets preparation process. This process may be conducted at a timing including after completion of forming any of desired crosslinked structure, and may be conducted at several times separately in view of controlling crosslinked reaction. Specifically, a method is specifically in which polyester concentration is enhanced in certain degree by removing organic solvent in oil droplets prior to addition of a radical polymerization initiator, then crosslinked reaction is conducted by adding the radical polymerization initiator at the state, and finally toner particles are formed by removing organic solvent after forming desired all crosslinked structure.

The organic solvent may be removed by a known method to remove organic solvent. Specifically, it may be conducted by a process wherein whole dispersion liquid in which oil droplets is dispersed in an aqueous medium is subjected to raising temperature gradually while stirring at reduced pressure, and the solvent is removed in a predetermined temperature range.

In case of forming toner particles by employing dispersion stabilizer, removing treatment of dispersion stabilizer may be conducted by adding acid or alkali in addition to removing treatment of the organic solvent.

(5-2) Shape Control Treatment

Shape control treatment to control the shape of the toner particles may be conducted after the organic solvent removing process in the producing method of toner according to this invention.

In the shape control treatment, a dispersion of colored particles obtained in the previous step is subjected to passage through a micrometer-order filter or a treatment of stirring in an annular type continuous-stirring mill to perform shape control so that the major/minor axis ratio falls within the prescribed range.

Practical method of shape control process of toner particles includes a method in which toner particles are passed through gap, filter or pore, or centrifugal force is applied to toner particles by a high speed rotation. The practical shape control device of the toner particles includes a piston type high pressure homogenizer and inline screw pump in addition to the above described an annular type continuous-stirring mill.

Desired shape of toner particles is realized by controlling factors such as period, temperature and speed of toner shape control process.

Thus the shape of toner particles is controlled and the toner particles having predetermined range of ratio of long axis to short axis.

Herein shape control treatment may be conducted prior to the organic solvent removing process, specifically, between crosslinked structure forming process and organic solvent removing process.

(6) Filtration and Washing Step:

In the step, a colored particle dispersion obtained in the previous step is cooled and subjected to a filtration treatment in which the colored particle dispersion is filtered for solid-liquid separation to separate the colored particles from the dispersion and a washing treatment to remove adhered materials such a surfactant from the separated colored particles. Specific methods for solid-liquid separation and washing include, for example, centrifugal separation, filtration under reduced pressure by using Buchner's funnel and filtration using a filter press.

(7) Drying Step:

In the drying step, the toner particles having been washed are subjected to a drying treatment. Drying machines usable in this drying step include, for example, a spray dryer, a vacuum freeze dryer, a vacuum dryer, a standing plate type dryer, a mobile plate type dryer, a fluidized-bed dryer, a rotary dryer and a stirring dryer. The moisture content of the thus dried colored particles is preferably not more than 5% by mass, and more preferably not more than 2% by mass.

The moisture content of colored particles is determined by Karl Fischer coulometric titration. Specifically, using an automatic heat-vaporization moisture measurement system AQS-724 (produced by Hiranuma Sangyo Co., Ltd.) constituted of a moisture meter AO-6 AQI-601 (interface for AQ-6) and a heat-vaporization device LE-24S, 0.5 g of colored particles which has been allowed to stand in an atmosphere of 20° C. and 50% RH for 24 hrs. is precisely weighed and placed into a 20 ml glass tube and sealed with Teflon-coated silicone rubber packing. The moisture content under the sealed environment is measured using reagents under the conditions described below. Two empty sample tubes are concurrently measured to correct the moisture content under the sealed environment.

Sample heating temperature: 110° C.

Sample heating time: 1 min.

Nitrogen gas flow rate: 150 ml/min

Reagent:

Opposing electrode liquid (cathode liquid);

HYDRANAL®—Coulomat CG-K

Generating liquid (anode liquid);

HYDRANAL® —Coulomat AK

When the toner particles subjected to drying treatment form agglomerate by weak attracting force between particles, the agglomerate may be subjected to shredding treatment. A mechanical type of shredder such as jet mill, HENSCHEL MIXER, a coffee mill and a food processor may be used as the shredder.

(8) External Additive Addition Step:

In the external additive addition step, a charge controlling agent, various organic or inorganic microparticles and a lubricant are added to the dried toner particles to improve fluidity or an electrostatic property and to enhance cleaning capability. Examples of a device used for adding external additives include a turbulent mixer, a HENSCHEL MIXER, a NAUTA MIXER or a V-type mixer. For instance, inorganic particles of silica, titania or alumina are preferably used and preferably, these inorganic particles are subjected to a treatment for hydrophobicity, using a silane coupling agent or a titanium coupling agent. External additives are incorporated preferably in an amount of 0.1 to 5.0% by mass of the toner, and more preferably 0.5 to 4.0% by mass. External additives may be used singly or in combination.

A toner having an excellent anti-high temperature offset property can be produced since crosslinked structure is formed in a state in which a polyester resin is dispersed into microparticles in an aqueous medium according to the above described producing method. Further, a toner for forming high quality image can be easily produced since a toner having small particle diameter can be produced by the above described a producing method. It is also possible to produce a toner having excellent low temperature fixing property as well as excellent anti-high temperature offset property with less energy since there is no process to disperse a resin having a crosslinked structure. Moreover, reaction control is easy since crosslinked structure is formed by a radical polymerization reaction employing a polymerisable unsaturated double bond, and as its result, the toner as described above can be produced stably.

The glass transition point (Tg) of a polyester resin is preferably from 30 to 60° C., and more preferably from 35 to 54° C. and the softening point is preferably from 70 to 140° C. and more preferably from 80 to 137° C.

The glass transition point (Tg) and the softening point are measured by using a toner as a sample, similarly to the manner as described earlier.

Particle Diameter of Toner Particles

A toner particles obtained by a producing method as described above is preferably to have particle diameter of 3 to 8 μm in terms of volume based median diameter. The particle diameter of the toner particles can be controlled by particle diameter of the oil droplets formed in the process of forming a crosslinked non-crystalline polyester resin or amount of dispersion stabilizer. When the volume based median diameter is within the range of 3 to 8 μm, not reproduction with fidelity to electrostatic latent image becomes possible and, reproduction ability of fine lines and a half tone image can be improved.

The volume-based particle size distribution degree of the toner of the invention is preferably from 16 to 35, and more preferably from 18 to 22.

CV value is obtained by the Formula (x) shown below. Herein, arithmetic mean particle diameter is a volume based mean value of particle diameter x of 25,000 toner particles, and the arithmetic mean particle diameter is measure via COULTER MULTISIZER 3, (Beckmann Coulter Co.).

$$CV\text{ value }(\%)=\{(\text{standard deviation})/(\text{arithmetic mean particle diameter})\}\times 100 \qquad \text{Formula (x)}$$

The volume-based median diameter ($D_{50}$) of toner particles can be determined using COULTER MULTISIZER 3 (Beckmann Coulter co.), connected to a computer system for data processing.

The measurement procedure is as follows 0.02 g of toner particles are added to 20 ml of a surfactant solution (for example, a surfactant solution obtained by diluting a surfactant containing neutral detergent with pure water to a factor of 10) and dispersed in an ultrasonic homogenizer to prepare toner dispersion. Using a pipette, the toner dispersion is placed into a beaker containing ISOTON II (produced by Beckman Coulter (Co.) within a sample stand, until reaching a measurement concentration of 7%. The measurement particle count number was set to 25000 to perform measurement. Then aperture diameter of the MULTISIZER 3 was 50 μm. The measurement range of 1 to 30 μm was divided into 256 portions determine the frequency number. A particle size corresponding to 50% of the volume-integrated fraction from the larger particles was defined as a volume-based median diameter.

Average Circularity of Toner Particles

In the toner obtained by the producing method, the average circularity of toner particles is preferably in the range of 0.930 to 1.000, and more preferably 0.945 to 0.995, in view of improving transfer efficiency.

When the average circularity satisfies the range of 0.930 to 1.000, high filling density of toner particles in a toner layer transferred to the recording material is obtained and therefore improved fixing property is obtained and fixing off-set is hard to generate. Further respective toner particle is hard to break, stain of friction charge giving member is reduced and chargeability of the toner is stabilized.

The circularity of toner particles can be determined using FPIA-2100 (produced by Sysmex Co.). Concretely, toner particles are added into an aqueous surfactant solution, dispersed ultrasonically for 1 min. and subjected to measurement using FPIA-2100. The measurement condition is set to HPF (high power flow) mode and measurement is conducted at an optimum concentration of the HPF detection number of 3,000 to 10,000. The circularity of a particle is determined according to the following formula (y), circularities of toner particles are summed and divided by the number of total particles to obtain the circularity of the toner particles:

Reproducibility can be obtained when HPF detection number, satisfies the above described range.

Circularity={(circumference of a circle having an area equivalent to the projected area of a particle)/(a circumference of the projected particle)}. Formula (y)

Developer

When using the toner of the invention as a single-component developer by incorporating a magnetic material or as a two-component developer by mixing a so-called carrier, a nonmagnetic toner can be used alone, and the toner is suitably applied to both.

There are usable known materials as a carrier constituting a two-component developer, including, for example, metals such as iron, ferrite and magnetite, and alloys of metals such as aluminum. Of these, ferrite particles are preferred.

The volume-average particle size of a carrier is preferably from 15 to 100 μm, and more preferably 25 to 60 μm. The volume-average particle size of the carrier can be determined using a laser diffraction type particle size distribution measurement apparatus provided with a wet disperser, HELOS (produced by SYMPANTEC Corp.).

Preferred carriers include resin-coated carrier in which the surface of magnetic particles is covered with resin and a resin dispersion type carrier in which magnetic particles are dispersed in resin. Resins constituting the resin coated carrier are not specifically limited but an olefin resin, a styrene resin, a styrene/acryl resin, a silicone resin, an ester resin, or a fluorine-containing polymer resin is usable. Resins constituting the resin dispersion type carrier are not specifically limited but a polyester resin, a fluororesin, or a phenol resin is usable.

Image Forming Method

The toner described above is suitable in an image forming method including a fixing step by a contact heating system. In this image forming method, an electrostatic latent image which has been electrostatically formed on an image bearing body is developed by allowing the developer to be electrostatically charged by a frictional-charging member in a developing device to obtain a toner image and the obtained toner image is transferred onto a recording material, thereafter, the transferred toner image is onto the recording material fixed by a contact-heating system to obtain a visible image.

Embodiments of the invention have been described but are not limited to these and various changes and modification can be made therein.

EXAMPLES

The invention will be further described with reference to examples

Synthesis Example A of Unsaturated Non-Crystalline Polyester Resin

Into a reaction vessel equipped with a stirring device, a nitrogen inlet pipe, temperature sensor and rectifying column, the followings are charged.

polycarboxylic acid: 4.2 parts by mass of fumaric acid and 78 parts by mass of terephthalic acid, polyalcohol: 152 parts by mass of 2,2-bis(4-hydroxy phenyl) propane propylene oxide 2 mol adduct and 48 parts by mass of 2,2-bis(4-hydroxy phenyl)propane ethylene oxide 2 mol adduct.

Temperature within the system was raised to 190° C. taking one hour, after affirming that the inside of the system is stirred uniformly, catalyst Ti $(OBu)_4$ in an amount of 0.006% by mass of total amount of polycarboxylic acid, temperature within the system was raised to 240° C. taking 6 hours while removing generated water by distillation, and polymerization reaction was conducted by continuing dehydration condensation reaction for 6 hours maintaining the temperature, and an unsaturated non-crystalline polyester resin (A) was obtained.

Thus obtained crystalline polyester resin (B) had number-average molecular weight (Mn) of 2,900, and a melting point of 65° C. The crystalline polyester resin (B) molecular weight and the melting point of the crystalline polyester resin (B) were measure as described earlier.

Synthesis Example B of Crystalline Polyester Resin

Into a reaction vessel equipped with a stirrer, a nitrogen-introducing tube, temperature sensor and rectifying column, the following was charged;

Polycarboxylic acid: 200 parts by mass of dodecane diacid, and

Polyalcohol: 140 parts by mass of 1,9-nonane diol.

Temperature within the system was raised to 190° C. taking one hour, after affirming that the inside of the system is stirred uniformly, catalyst Ti $(OBu)_4$ in an amount of 0.006% by mass of total amount of polycarboxylic acid, temperature within the system was raised to 240° C. taking 6 hours while removing generated water by distillation, and polymerization reaction was conducted by continuing dehydration condensation reaction for 6 hours maintaining the temperature, and an crystalline polyester resin (B) was obtained.

Thus obtained crystalline polyester resin (B) had number-average molecular weight (Mn) of 2,900, and a melting point of 65° C. The crystalline polyester resin (B) molecular weight and the melting point of the crystalline polyester resin (B) were measured as described earlier.

Production Example of Toner 1

(Oil Phase Liquid Preparation Process)

Into a reaction tank equipped with a stirring device, a temperature sensor, a condenser tube and a nitrogen inlet pipe, 450 parts by mass of ethyl acetate, 267 parts by mass of unsaturated non-crystalline polyester resin (A), 37 parts by mass of crystalline polyester resin (B), 4 parts by mass of copper phthalocyanine blue, 4 parts by mass of carbon black and 15 parts by mass of pentaerythritol tetra stearate were charged and oil phase liquid (1) composed of toner components was obtained by stirring for two hours at 70° C.

(Aqueous Dispersion Liquid of Oil Droplets Preparation Process)

On the other side, into another reaction tank 600 parts by mass of ion-exchanged water and 0.3 parts by mass of sodium dodecylbenzene sulfonate were charged, oil phase liquid (1) composed of toner components was poured while stirring at 12,000 rpm via TK HOMOMIXER Mark II Model 2.5 (product by PRIMIX Corp.) at a temperature of 70° C., and aqueous dispersion liquid (1) was obtained by stirring for 30 minutes. Dispersion particle diameter of oil droplets (volume based median diameter) was 230 nm. The dispersion particle diameter of oil droplets measured as described earlier. This is common hereafter.

(Crosslinked Structure Forming Process and Organic Solvent Removing Process)

Thereafter, into another reaction tank equipped with a stirrer, a nitrogen-introducing tube, temperature sensor and rectifying column, aqueous dispersion liquid (1) cooled down to 40° C. was poured, 380 part by mass of ethyl acetate was removed by distillation at reduced pressure at 50 mmHg, pressure was brought back ordinal pressure, and temperature was raised to 70° C., an initiator aqueous solution of 6.3 parts by mass of potassium persulfate dissolved in 42 parts by mass of ion-exchanged water was put, 60 parts by mass of tricalcium phosphate and 0.3 parts by mass of sodium dodecyl sulfate were added when particles were grown up to 5.5 μm in terms of volume based median diameter, and reaction was conducted for 2 hours. After that it was cooled down to 40° C., ethyl acetate was removed at reduced pressure of 50 mmHg, and further, tricalcium phosphate at a surface of toner particles was dissolved off by adding 120 parts by mass of 35% concentrated hydrochloric acid.

(Filtration/Washing and Drying Process)

Subsequently, toner cake subjected to solid/liquid separation and dehydration was dispersed again in ion-exchanged water, solid/liquid separation was three times repeated and toner particles were washed. Then toner (1X) composed of toner particles (1) was obtained by drying at 40° C. for 24 hours.

Volume based median diameter of toner particles (1) in toner (1X) was 5.2 μm, and average circularity was 0.964.

(External Additive Addition Process)

100 parts by mass of the obtained toner (1X), 0.6 parts by mass of hydrophobic silica (number average primary particle diameter of 12 nm, hydrophobic degree of 68) and 1.0 parts by mass of hydrophobic titanium oxide (number average primary particle diameter of 20 nm, hydrophobic degree of 63) were added and blended by HENSCHEL MIXER (product by Mitsui Mike Kakoki Co.) at rotor blade circumferential speed of 35 mm/sec, at 32° C. for 20 minutes and Toner (1) was produced via external additive treatment remove coarse particles employing a sieve having aperture of 4 μm.

Production Example of Toners 2 to 5

Toners 2 to 5 were obtained in the same manner as production example of toner 1 except that unsaturated non-crystalline polyester resins (A2) to (A5) were respectively employed in place of unsaturated non-crystalline polyester resin (A).

Synthesis Example of Unsaturated Non-Crystalline Polyester Resin A2

Unsaturated non-crystalline polyester resin (A2) was obtained in the same manner as the synthesis example of unsaturated non-crystalline polyester resin A, except that 2.4 parts by mass of itaconic acid, 36 parts by mass of terephthalic acid and 5.2 parts by mass of isophthalic acid were used as the polycarboxylic acid.

Thus obtained unsaturated non-crystalline polyester resin (A2) had number-average molecular weight (Mn) of 2,900 and glass transition point (Tg) of 66° C.

Synthesis Example of Unsaturated Non-Crystalline Polyester Resin A3

Unsaturated non-crystalline polyester resin (A3) was obtained in the same manner as the synthesis example of unsaturated non-crystalline polyester resin A, except that 37 parts by mass of terephthalic acid and 6 parts by mass of isophthalic acid as polycarboxylic acid; and 71 parts by mass of 2,2-bis(4-hydroxy phenyl) propane propylene oxide 2 mol adduct, 19 parts by mass of 2,2-bis(4-hydroxy phenyl)propane ethylene oxide 2 mol adduct, and 71 parts by mass of 2-buten 1,4-diol as polyalcohol were used.

Thus obtained unsaturated non-crystalline polyester resin (A3) had number-average molecular weight (Mn) of 3,200, and glass transition point (Tg) of 65° C.

Synthesis Example of Unsaturated Non-Crystalline Polyester Resin A4

Unsaturated non-crystalline polyester resin (A4) was obtained in the same manner as the synthesis example of unsaturated non-crystalline polyester resin A, except that 9.8 parts by mass of maleic acid and 36 parts by mass of terephthalic acid were used as the polycarboxylic acid.

Thus obtained unsaturated non-crystalline polyester resin (A4) had number-average molecular weight (Mn) of 3,500 and glass transition point (Tg) of 61° C.

Synthesis Example of Unsaturated Non-Crystalline Polyester Resin A5

Unsaturated non-crystalline polyester resin (A5) was obtained in the same manner as the synthesis example of unsaturated non-crystalline polyester resin A, except that 5.8 parts by mass of itaconic acid, 36 parts by mass of terephthalic acid and 5.2 parts by mass of isophthalic acid were used as the polycarboxylic acid.

Thus obtained unsaturated non-crystalline polyester resin (A5) had number-average molecular weight (Mn) of 4,400 and glass transition point (Tg) of 59° C.

Production Example of Toners 6 to 10

Toners 6 to 10 were produced in the same manner as production example of toner 1, except that dispersion particle diameter of oil droplets (volume based median diameter) was controlled as shown in Table 1, respectively.

Production Example of Toner 11

Comparative Sample

Aqueous dispersion liquid (1) was obtained in the same manner as production example of toner 1, the following process were conducted in place of the crosslinked structure process and the organic solvent removing process.

Thereafter, into another reaction tank equipped with a stirrer, a nitrogen-introducing tube, temperature sensor and rectifying column, aqueous dispersion liquid (1) cooled down to 40° C. was poured, ethyl acetate was removed by distillation at reduced pressure at 50 mmHg, pressure was brought back ordinal pressure, and temperature was raised to 80° C., 60 parts by mass of tricalcium phosphate and 0.3 parts by mass of sodium dodecyl sulfate were added when particles were grown unto 5.5 μm in terms of volume based median diameter, and reaction was conducted for 2 hours. After that it was cooled down to 40° C., ethyl acetate was removed at reduced pressure of 50 mmHg, and further, tricalcium phosphate at a surface of toner particles was dissolved off by adding 120 parts by mass of 35% concentrated hydrochloric acid.

Toner 11 of comparative sample was obtained through the filtration/washing and drying process and external additive addition process of production example of toner 1.

Production Example of Carrier

Manganese/magnesium ferrite having weight average particle diameter of 50 μm was spray coated with coating material composed of 85 parts by mass of silicone resin (oxime hardened type, toluene solution) as solid substance, 10 parts by mass of γ-aminopropyl trimethoxysilane (coupling agent), 3 parts by mass of alumina particles (particle diameter of 100 nm) and 2 parts by mass of carbon black, and was sintered at 190° C. for 6 hours. Resin coated carrier was obtained by cooling down to ordinal temperate. Average thickness of the resin coat was 0.2 μm.

Production Example of Developer 1 to 11

Developers (1) to (10) and developer comparative sample (11) were produced by mixing 94 parts by mass of carrier produced as above described and each of 6 parts by mass of toners (1) to (10) and toner comparative sample (11), respectively. The mixing process was terminated when the toner charge amount reaches to 20 to 23 μC/g, and the developer was once poured in polyethylene pot.

Evaluation 1: Fixing Off-Set

A4 size normal papers (basis weight: 80 g/m$^2$) each having unfixed image formed by the developers (1) to (11) were conveyed in longitudinal direction by employing commercially available digital system multi functional printer BIZHUB PRO C6501 (produced by Konica Minolta Business Technologies, Inc.), which is modified so that temperature of a surface of fixing roller is changed in a range from 100 to 210° C., and fixing was conducted at each 5° C., temperatures at which image stain due to fixing off-set generates on both of low and high temperature side were examined. The unfixed image had a solid stripe image having stripe image of 5 mm width and a half tone image having 20 mm width in an orthogonal direction to the conveying direction.

Fixing temperature at which image stain due to fixing off-set generated at low and a high temperature sides are referred to as low offset temperature, and high offset temperature, respectively. Results are shown in Table 1.

Evaluation 2: Available Lowest Fixing Temperature

Test of fixing A4 size normal papers (basis weight: 80 g/m$^2$) each having solid image having toner adhesion amount of 11 mg/10 cm$^2$ formed by the developers (1) to (11) was conducted by employing commercially available digital system multi functional printer BIZHUB PRO C6501 (produced by Konica Minolta Business Technologies Inc.), which is modified so that temperature of a surface of fixing roller is changed in a range from 100 to 210° C., and the test was conducted by changing fixing temperature a each 5° C., such as 100, 105° C., and the like repeatedly.

Printed matter obtained by the fixing test at each temperature was folded via folding machine applying pressure of 100 kPa in terms of area pressure to solid image portion. Compressed air was blown to the fold portion at a pressure of 0.35 MPa, and the status of the fold portion was evaluated into 5 ranks as described below by referring to a criteria sample. Fixing temperature of rank 3 was made as the available lowest fixing temperature. Results are shown in Table 1.

Evaluation Criteria

Rank 5: No peeling is observed at the fold portion.

Rank 4: Peeling is observed partly along with the fold line.

Rank 3: Peeling of fine lines is observed along with the fold line.

Rank 2: Peeling of bald lines is observed along with the fold line.

Rank 1: Large peeling is observed.

TABLE 1

| | | | Dispersion | | | Evaluation | | |
|---|---|---|---|---|---|---|---|---|
| | Toner No. | Use of polymerization Initiator | particle diameter of oil droplet | Particle diameter of toner | Average circularity of toner particles | Available lowest fixing temperature | Low offset temperature | High offset temperature |
| Example 1 | 1 | Yes | 230 nm | 5.2 μm | 0.964 | 135° C. | 135° C. | Not observed |
| Example 2 | 2 | Yes | 240 nm | 5.3 μm | 0.961 | 135° C. | 130° C. | 210° C. |
| Example 3 | 3 | Yes | 210 nm | 5.3 μm | 0.958 | 140° C. | 140° C. | Not observed |
| Example 4 | 4 | Yes | 200 nm | 5.5 μm | 0.963 | 135° C. | 135° C. | Not observed |
| Example 5 | 5 | Yes | 230 nm | 5.4 μm | 0.955 | 145° C. | 140° C. | Not observed |
| Example 6 | 6 | Yes | 70 nm | 5.5 μm | 0.942 | 140° C. | 140° C. | Not observed |
| Example 7 | 7 | Yes | 90 nm | 5.3 μm | 0.966 | 135° C. | 135° C. | Not observed |
| Example 8 | 8 | Yes | 450 nm | 5.5 μm | 0.946 | 140° C. | 130° C. | Not observed |

TABLE 1-continued

| | | | Dispersion | | | Evaluation | | |
|---|---|---|---|---|---|---|---|---|
| | Toner No. | Use of polymerization Initiator | particle diameter of oil droplet | Particle diameter of toner | Average circularity of toner particles | Available lowest fixing temperature | Low offset temperature | High offset temperature |
| Example 9 | 9 | Yes | 720 nm | 5.7 μm | 0.940 | 135° C. | 130° C. | 210° C. |
| Example 10 | 10 | Yes | 1,130 nm | 5.8 μm | 0.935 | 135° C. | 130° C. | 210° C. |
| Comparative Sample 1 | 11 | No | 240 nm | 5.3 μm | 0.968 | 145° C. | 140° C. | 200° C. |

The invention claimed is:

1. A method of producing a toner comprising toner particles containing a binder resin, the binder resin comprising a non-crystalline polyester resin having a crosslinked structure and a crystalline polyester resin, the method comprising steps of:

dissolving or dispersing a non-crystalline polyester resin having a polymerizable unsaturated double bond and a crystalline polyester resin in an organic solvent to form an oil phase liquid, dispersing the oil phase liquid in an aqueous medium to form an aqueous dispersion liquid of oil droplets of the oil phase liquid, adding a radical polymerization initiator to the aqueous dispersion liquid of oil droplets, the oil droplets comprising the non-crystalline polyester resin having a polymerizable unsaturated double bond and the crystalline polyester resin, whereby a polymerizable unsaturated double bond of the unsaturated non-crystalline polyester resin is subjected to radical polymerization reaction to form a non-crystalline polyester resin having a crosslinked structure in the oil droplets, and removing the organic solvent from the oil droplets comprising both of the non-crystalline polyester resin having crosslinked structure and the crystalline polyester resin after forming crosslinked structure to form toner particles.

2. The method of claim 1 wherein a particle diameter of the oil droplets of the oil phase liquid formed by dispersing the oil phase liquid in the aqueous dispersion liquid is 60 to 1,000 nm.

3. The method claim 1, wherein the crystalline polyester resin has a number average molecular weight of 100 to 10,000.

4. The method of claim 3, wherein the crystalline polyester has a number average molecular weight 800-5,000.

5. The method of claim 1, wherein the crystalline polyester resin has a weight average molecular weight of 1,000 to 50,000.

6. The method of claim 5, wherein the crystalline polyester resin has a weight average molecular weight of 2,000 to 30,000.

7. The method of claim 1, wherein the unsaturated non-crystalline polyester resin has a glass transition point temperature of 20 to 90° C.

8. The method of claim 7, wherein the unsaturated non-crystalline polyester resin has a glass transition point temperature of 35 to 65° C.

9. The method of claim 1, wherein the unsaturated non-crystalline polyester resin has a softening point of 80 to 220° C.

10. The method of claim 9, wherein the unsaturated non-crystalline polyester resin has a softening point of 80 to 150° C.

11. The method of claim 1, wherein the unsaturated non-crystalline polyester resin has a number-average molecular weight of 2,000 to 10,000.

12. The method of claim 1, wherein the unsaturated non-crystalline polyester resin has a number-average molecular weight of 2,500 to 8,000.

13. The method of claim 1, wherein the unsaturated non-crystalline polyester resin has a weight average molecular weight of 3,000 to 100,000.

14. The method of claim 1, wherein the unsaturated non-crystalline polyester resin has a weight average molecular weight of 4,000 to 70,000.

* * * * *